United States Patent [19]

Carlos

[11] Patent Number: 5,063,626

[45] Date of Patent: Nov. 12, 1991

[54] DUST RUFFLE

[76] Inventor: Mary L. Carlos, 4500 Roland Ave., Dallas, Tex. 75219

[21] Appl. No.: 611,673

[22] Filed: Nov. 13, 1990

[51] Int. Cl.[5] ..... A47G 9/02

[52] U.S. Cl. ..... 5/493

[58] Field of Search ..... 5/493, 497, 502, 482

[56] References Cited

U.S. PATENT DOCUMENTS

| | | | |
|---|---|---|---|
| 3,144,666 | 8/1964 | Mazera et al. | 5/493 |
| 3,999,233 | 12/1976 | Morris | 5/493 |
| 4,141,097 | 2/1979 | Levinsohn et al. | 5/493 |
| 4,386,439 | 6/1983 | Roccograndi et al. | 5/493 |
| 4,734,947 | 4/1988 | Vitale | 5/493 |
| 4,796,317 | 1/1989 | Kallman et al. | 5/493 |

*Primary Examiner*—Alexander Grosz
*Attorney, Agent, or Firm*—Michael A. O'Neil

[57] ABSTRACT

A dust ruffle having a section of woven fabric with dimensions slightly larger than a box spring, and a section of decorative fabric attached to the section of woven fabric along the perimeter of the horizontal surface of the box spring, which descends vertically to a point touching the floor. An elastic band is attached to the peripheral edges of the section of woven fabric to enable the woven fabric to substantially conform to the shape of the box spring. A shaped strip of decorative fabric is superimposed on, and attached to the section of woven fabric along the perimeter of the horizontal surface of the box spring.

6 Claims, 1 Drawing Sheet

DUST RUFFLE

TECHNICAL FIELD

This invention relates generally to bedding, and more particularly to the positioning of a dust ruffle on a bed.

BACKGROUND OF THE INVENTION

Dust ruffles have been used over the years to decrease dust collection under beds and to provide an aesthetically pleasing appearance to the bedroom. Typically, dust ruffles comprise a piece of decorative fabric attached on three sides to a piece of less costly, flat sheet-like fabric, which is sandwiched between the box spring and mattress of a bed. The major problem with this design is that the dust ruffle has no structure to secure its position on the bed. In response to the natural movements of sleepers during the night, the unsecured dust ruffle has a tendency to shift from side to side or from the head towards the foot of the bed. Left unchecked, the dust ruffle is no longer evenly distributed on the bed, creating an unsightly appearance.

Initially, dust ruffle users relied on the weight of the mattress to secure the dust ruffle in place, accompanied by regular removal of the mattress from the bed in order to reorient the dust ruffle to its proper position. When this proved unsatisfactory, many dust ruffle users resorted to employing safety pins to secure the dust ruffle to the box spring. Although this approach solved the problem of the dust ruffle's tendency to shift, it had an unsatisfactory side-effect. The weight and the unstructured design of the dust ruffle, in combination with the movements of sleepers, caused the safety pins to strain against and ultimately tear the dust ruffle at it points of attachment. The dust ruffle user had to regularly repair the tears in the fabric or replace the dust ruffle.

In an effort to eliminate the foregoing combination of undesirable characteristics, dust ruffles have been constructed with an elastic means conforming the dust ruffle to the shape of a bed. Although such fitted products have generally proven effective in securing the dust ruffle to the bed, prior designs have not been acceptable for prolonged use. For example, the product described in U.S. Pat. No. 4,734,947, utilizes attachment of the dust ruffle to a fitted mattress pad, which overlies the mattress of a bed. Using an elastic means solves the shifting dust ruffle problem, however, it creates at least two additional problems. First, any soiling of the bed sheets and underlying mattress pad which requires removal of same for cleaning, also necessitates cleaning of the dust ruffle. Since most dust ruffles are constructed of decorative fabric which must be drycleaned, the dust ruffle user is forced to dryclean the mattress pad solely due to the attached dust ruffle. This is a costly and unnecessary expense. Repeated drycleaning, with its associated chemicals, also decreases the life of the dust ruffle. Additionally, during the period of time that the mattress pad and attached dust ruffle are being cleaned, the dust ruffle user needs a replacement dust ruffle, or is forced to leave the bed with a less-than-finished appearance. Both choices are undesirable.

Secondly, stress is placed on the peripheral edges of the mattress pad, along which the dust ruffle is attached. Over a prolonged period of time, the weight of the dust ruffle may cause the elastic means to lose its elasticity. Additionally, the weight of the dust ruffle tends to pull the edges of the mattress pad from underneath the mattress. Furthermore, weight of the dust ruffle may also cause pulling and tearing of the fabric along the line of attachment, similar to the tears produced by the use of safety pins.

SUMMARY OF THE INVENTION

The present invention comprises a highly practical dust ruffle which overcomes the foregoing disadvantages associated with the prior art. A fitted support member comprises a substantially rectangular section of woven fabric to which a dust ruffle is joined. The support member has mitered corners, and an elastic member is employed to substantially conform the support member to the shape of a box spring. A U-shaped strip of the same decorative fabric used in the construction of the dust ruffle is superimposed on and attached to the support member. The U-shaped strip provides a uniform appearance if the mattress is moved slightly out of position; aids in the proper orientation of the dust ruffle so that the ruffle descends from the edges of the box spring; and provides additional support to the support member against strain from the weight of the dust ruffle fabric.

The resulting construction ensures that the dust ruffle will remain in proper position on the box spring, while permitting the dust ruffle user to change the bed sheets or flip the mattress.

DESCRIPTION OF THE DRAWINGS

For a more complete understanding of the present invention and the advantages thereof, reference is now made to the following Detailed Description taken in conjunction with the accompanying Drawings in which.

DETAILED DESCRIPTION

Figure 1:
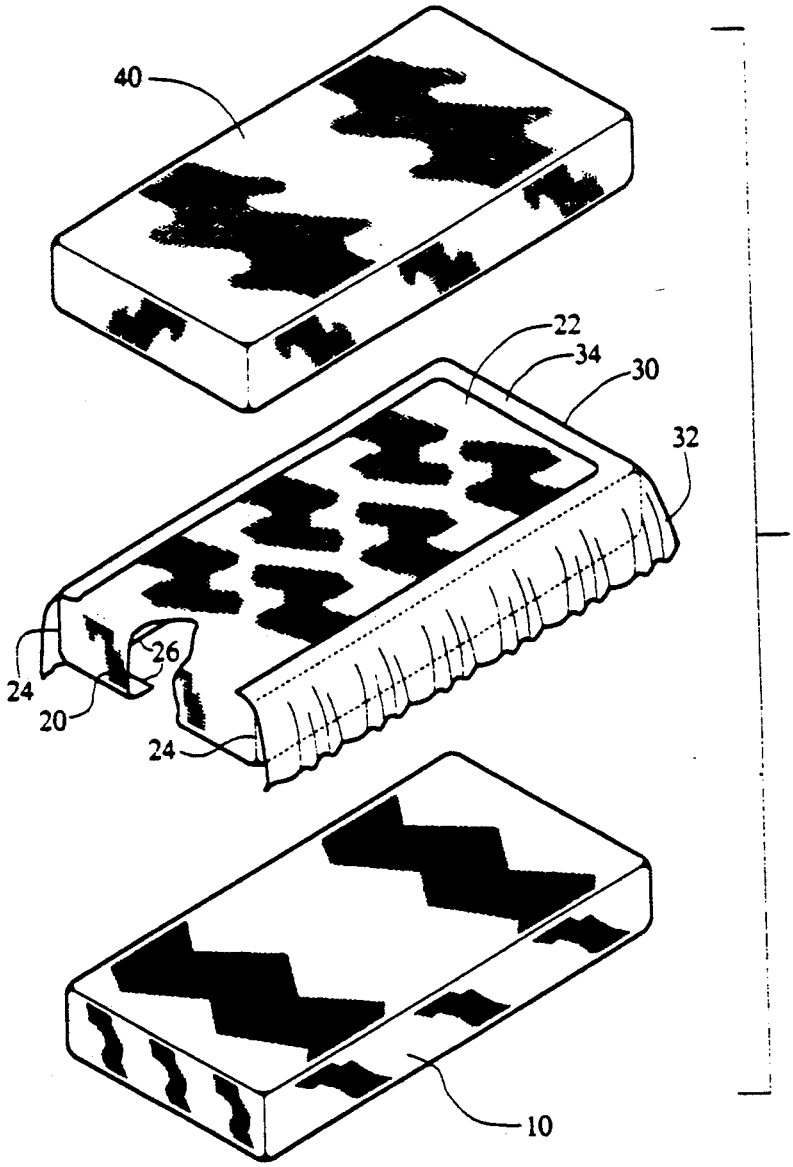
FIG. 1 is an exploded view of a bed with dust ruffle, showing the features of the invention and the spatial relationship between the dust ruffle, box spring and mattress.

Referring now to the drawings wherein like reference characters designate like or similar parts throughout the several views, FIG. 1 is an exploded view of an assembled bed, showing the features of the invention. FIG. 1 shows a box spring 10 which is covered by a support member 20 with attached dust ruffle 30. A mattress 40 overlies the box spring 10 and the support member 20. The box spring 10 may rest on top of a conventional bed frame 12. In a preferred embodiment, the support member 20 is constructed of a section of woven fabric 22 which has dimensions slightly larger than the shape of the box spring 10, and which is of substantially rectangular shape. The woven fabric 22 may be muslin or any other low cost fabric. The support member 20 has mitered corners 24 and an elastic band 26 which substantially conforms the support member 20 to the shape of the box spring 10. The elastic band 26 is attached to the peripheral edges of the support member 20, such that when the support member 20 is placed on the box spring 10, the elastic band 26 is positioned on the underside of the box spring 10. The dust ruffle 30 consists of several sections of decorative fabric which are attached to the support member 20. The main section of dust ruffle 32 is secured to the support member 20 along the perimeter of the horizontal surface of the box spring 10, and descends vertically to a point touching the floor. This section of fabric may be gathered, pleated, etc. pursuant to the dust ruffle user's wishes. A U-shaped strip of decorative fabric 34 is superimposed on and attached to the support member 20 along the perimeter of the horizontal surface of the box spring 10 and along a line inward towards the center of the bed. In a preferred embodiment, this U-shaped strip of decorative fabric 34 is approximately one to two feet in width.

Figure 2:
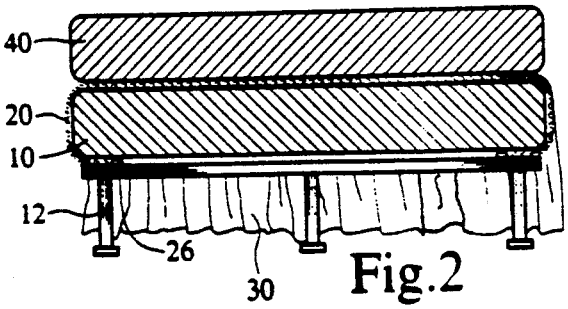
FIG. 2 is a longitudinal cross-sectional view of an assembled bed showing attachment of the dust ruffle to the support member.

Referring to FIG. 2, the box spring 10 is covered by the support member 20 with attached dust ruffle 30. The box spring 10 rests on top of the bed frame 12. The mattress 40 overlies the box spring 10 and the support member 20. The support member 20 consists of the section of woven fabric 22 which has an elastic band 26. The dust ruffle 30 is attached to the support member 20 along the perimeter of the horizontal surface of the box spring 10. The main part of the dust ruffle 32 descends vertically to a point touching the floor.

Figure 3:
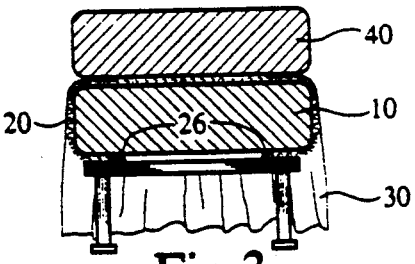
FIG. 3 is a transverse cross-sectional view of an assembled bed, showing attachment of the dust ruffle to the support member on three sides only.

Turning to FIG. 3, the dust ruffle 30 is attached to the support member 20 on three sides only. The mattress 40 overlies the box spring 10 and the support member 20 with attached dust ruffle 30.

Although a preferred embodiment of the invention has been illustrated in the accompanying Drawings and described in the foregoing Detailed Description, it will be understood that the invention is not limited to the embodiment disclosed, but is capable of numerous rearrangements, modifications and substitutions of parts and elements without departing from the spirit of the invention.

I claim:

1. A unitary dust ruffle adapted to be positioned on a box spring which supports a mattress comprising: a section of fabric with dimensions slightly larger than the box spring, said fabric covering the horizontal top surface and vertical sides of the box spring and having peripheral edges extending beneath the bottom of the box spring, elastic means attached to the peripheral edges of the section of fabric to enable the section of fabric to substantially conform to the shape of the box spring, a first section of decorative fabric secured to the section of fabric along the perimeter of the horizontal surface of the box spring, and descending vertically towards the floor above which the box spring is supported; and a second section of decorative fabric, comprised of a U-shaped strip superimposed on and attached to the section of fabric along the perimeter of the horizontal surface of the box spring, and along a line spaced inwardly towards the center of the boxspring, this line corresponding to the width of the strip.

2. A dust ruffle according to claim 1 wherein the section of fabric is of substantially rectangular shape.

3. A dust ruffle according to claim 1 wherein the section of fabric includes mitered corners.

4. A dust ruffle according to claim 1 wherein the dust ruffle extends vertically from only three sides of the box spring.

5. A dust ruffle according to claim 1 wherein the width of the U-shaped strip of decorative fabric is uniform.

6. A dust ruffle according to claim 1 wherein the U-shaped strip of decorative fabric is approximately one to two feet in width.

* * * * *